US006655555B1

(12) United States Patent
Yankoglu et al.

(10) Patent No.: US 6,655,555 B1
(45) Date of Patent: Dec. 2, 2003

(54) PAINT DISPENSING SYSTEM

(75) Inventors: Basil N. Yankoglu, Raleigh, NC (US); Terry S. Fox, Raleigh, NC (US)

(73) Assignee: Direct Dye Delivery, LLC, Raleigh, NC (US)

( * ) Notice: Subject to any disclaimer, the term of this patent is extended or adjusted under 35 U.S.C. 154(b) by 8 days.

(21) Appl. No.: 10/080,166

(22) Filed: Feb. 21, 2002

(51) Int. Cl.[7] ..... B67D 5/00

(52) U.S. Cl. ..... 222/380; 222/43; 222/243; 222/309; 141/27; 141/95; 141/325

(58) Field of Search ..... 222/23, 31, 41, 222/43, 44, 47, 49, 50, 155, 158, 180–181.3, 185.1, 226, 243, 244, 246, 248, 309, 319, 335, 372, 380, 383.1, 384–387, 424.5, 425, 434, 438; 141/2, 18, 20.5, 25–27, 94, 95, 325, 326

(56) References Cited

U.S. PATENT DOCUMENTS

| | | | | | |
|---|---|---|---|---|---|
| 3,029,847 | A | * | 4/1962 | Baudhuin et al. | 141/104 |
| 3,052,376 | A | * | 9/1962 | Fogg | 222/43 |
| 3,066,830 | A | * | 12/1962 | Heiss et al. | 222/135 |
| 4,314,653 | A | * | 2/1982 | Sindoni | 222/41 |
| 5,356,041 | A | * | 10/1994 | Hellenberg et al. | 222/135 |
| 5,445,195 | A | * | 8/1995 | Kim | 141/104 |
| 6,164,497 | A | * | 12/2000 | Chia et al. | 222/309 |

* cited by examiner

*Primary Examiner*—J. Casimer Jacyna
(74) *Attorney, Agent, or Firm*—Coats & Bennett, P.L.L.C.

(57) ABSTRACT

A paint dispensing system including a container having a moveable piston contained therein wherein a paint containing area is defined between the piston and a portion of the container. A dispenser extends through an opening formed in the piston and by moving the piston against paint contained within the container results in paint being forced into the dispenser where the paint moves through the dispenser and through the piston to an outlet where the paint is dispensed.

7 Claims, 5 Drawing Sheets

PAINT DISPENSING SYSTEM

BACKGROUND OF THE INVENTION

Most present day paint mixing systems utilize an array of paint colorants that are selectively mixed with a paint base to yield a particular paint color. Typically there are many different paint colorants and the number of paint colorants will vary from paint manufacturer to paint manufacturer. In any event, by selectively dispensing and mixing one or more of the paint colorants with a paint base, a particular paint color can be realized.

In most commercial paint mixing operations, there is provided a separate mixing vat for each paint colorant. That is, if a particular manufacturer utilizes 18 different paint colorants, there would be 18 different mixing vats. The mixing vats are filled with a particular paint colorant and because the vats are open to the atmosphere, it is necessary that they include a mixer. Consequently, there is typically provided an electric mixer with each vat and the paint colorant is mixed within the vat before dispensing to avoid pigment separation.

Typically, there is provided a dispenser associated with each vat. The dispenser is operative to induce or suck a selected volume of paint colorant from the vat and then to dispense that paint colorant into a can or other container that includes the base paint. Once all of the paint colorants for a particular formula have been measured and dispensed into the paint base, then the paint base and the various paint colorants are mixed to form the final paint color.

While these mixing systems of the prior art are widely used by paint stores and building supply houses, they do have some disadvantages and shortcomings. Principally among the shortcomings is the fact that the present day paint mixing systems are what is referred to as an open paint mixing system. That is, the vats are open to the atmosphere and to stabilize the paint colorant held within the vat, it is necessary that the vats be provided with mixing capabilities. This of course requires power, typically in the form of an electric motor. Consequently, the systems become relatively large, bulky and immobile. Thus, painters and paint contractors are required to travel to paint stores and building supply houses in order to obtain paint because with the present day paint mixing and dispensing systems, it is simply not practical to provide a mobile system that can mix and dispense paint at the job site.

Therefore, there has been and continues to be a need for a paint mixing and dispensing system that is generally closed and which lends itself to being mobile.

SUMMARY OF THE DESCRIPTION

The present invention entails a method and system for mixing and/or dispensing paint colorants wherein the paint colorants are maintained within a closed system. In one embodiment of the present invention, the closed system for dispensing paint colorant includes a container for holding a paint colorant and a paint colorant dispenser disposed adjacent the container for receiving paint colorant from the container and dispensing the paint colorant therefrom. A flow connector is interconnected between the container and the dispenser and this flow connector enables paint colorant to move from the container into the dispenser. Substantially the entire system comprised of the container, the flow connector and the dispenser are maintained closed or relatively air tight.

In one particular embodiment, both the container and the dispenser are provided with a piston that effectively engages the paint colorant and discharges the same from either the container or the dispenser. In this embodiment, paint colorant is discharged from the container through the flow connector into the dispenser. Once in the dispenser, the piston is actuated and pushed through a chamber causing the paint colorant to be discharged.

In another embodiment of the present invention, there is provided an adjustable volume control that enables precise volumes of paint colorant to be dispensed from the dispenser. One design for the adjustable volume control entails a measuring scale and an adjustable gauge that is moveable up and down adjacent the measuring scale. A stop operatively associated with the piston of the dispenser travels back and forth with the piston and is disposed in alignment with the gauge. Thus, the setting of the gauge at a particular location adjacent the measuring scale prevents the stop associated with the piston from moving past the gauge, and consequently limits the stroke of the piston within the dispenser and accordingly controls the volume of paint colorant discharged from the dispenser.

In addition, the present invention entails a container for commercially packaging a paint colorant. The packaging includes a container adapted to receive the paint colorant after manufacture and serve as a package or container for the paint colorant throughout its commercial life. Forming a part of this commercial package is a wall structure and an internal piston. The internal piston is moveable mounted internally within the package and can be moved through the container or the package to discharge paint colorant therefrom.

Another embodiment of the present invention comprises a paint dispenser for dispensing paint. This paint dispenser includes a container having a piston disposed within the container and moveable within the container. The piston includes a surrounding edge that forms a generally liquid-tight seal with the wall structure of the container and defines a paint containing area between the piston and the container. An opening is formed within the piston and a dispenser extends through the opening within the piston and includes an intake section that extends into the paint containing area. Further, the dispenser includes an outlet section disposed on the side of the piston opposite the intake section. When the piston is moved against the volume of paint contained within the paint containing area, paint is forced into the intake section of the dispenser and through the dispenser as it extends through the opening in the piston to an outlet section of the dispenser where the paint is dispensed.

Other objects and advantages of the present invention will become apparent and obvious from a study of the following description and the accompanying drawings, which are merely illustrative of such invention.

METHOD AND SYSTEM FOR DISPENSING PAINT

Figure 1:
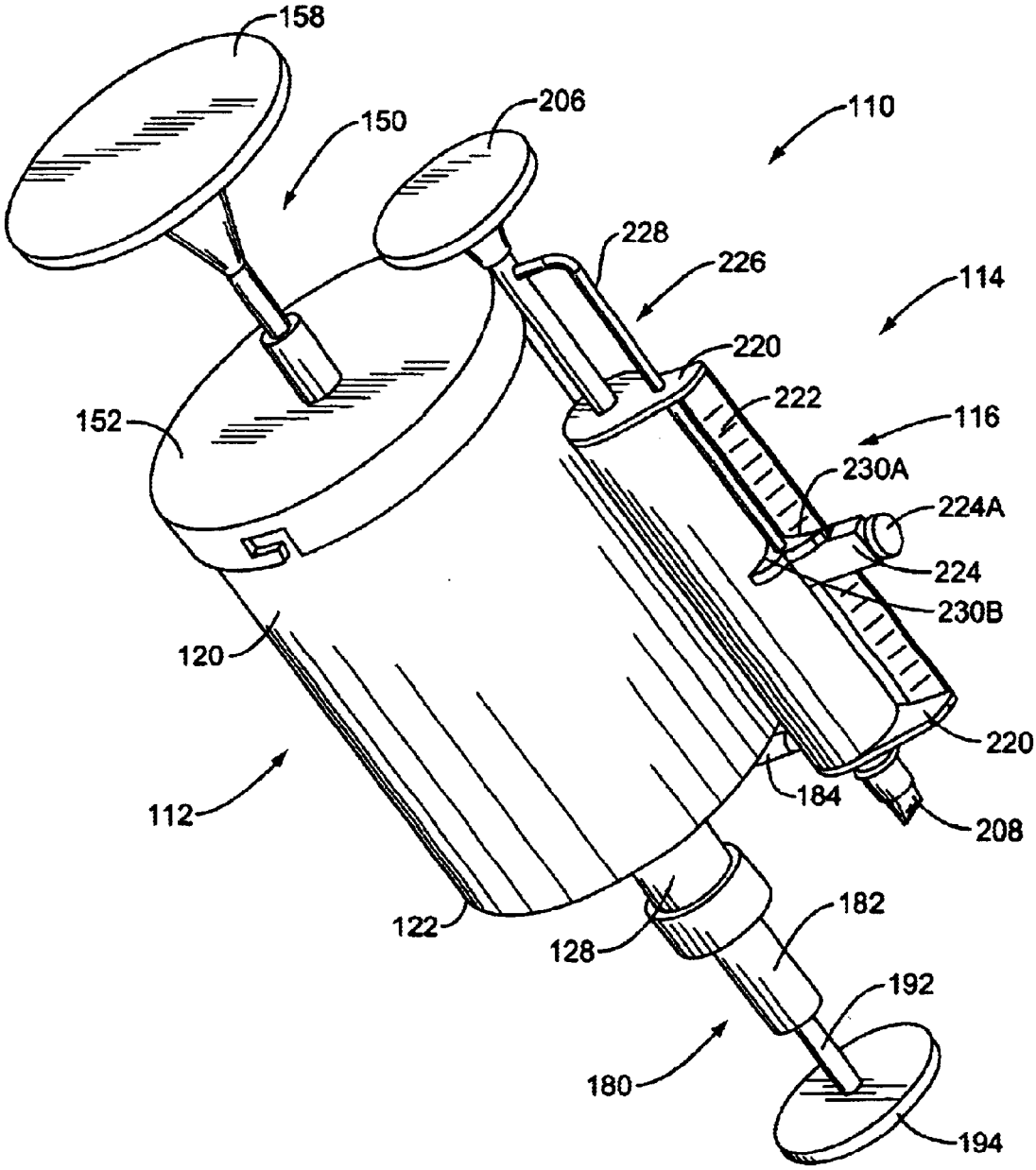
FIG. 1 is a perspective view of a system for dispensing and mixing paint colorant.
Figure 2:
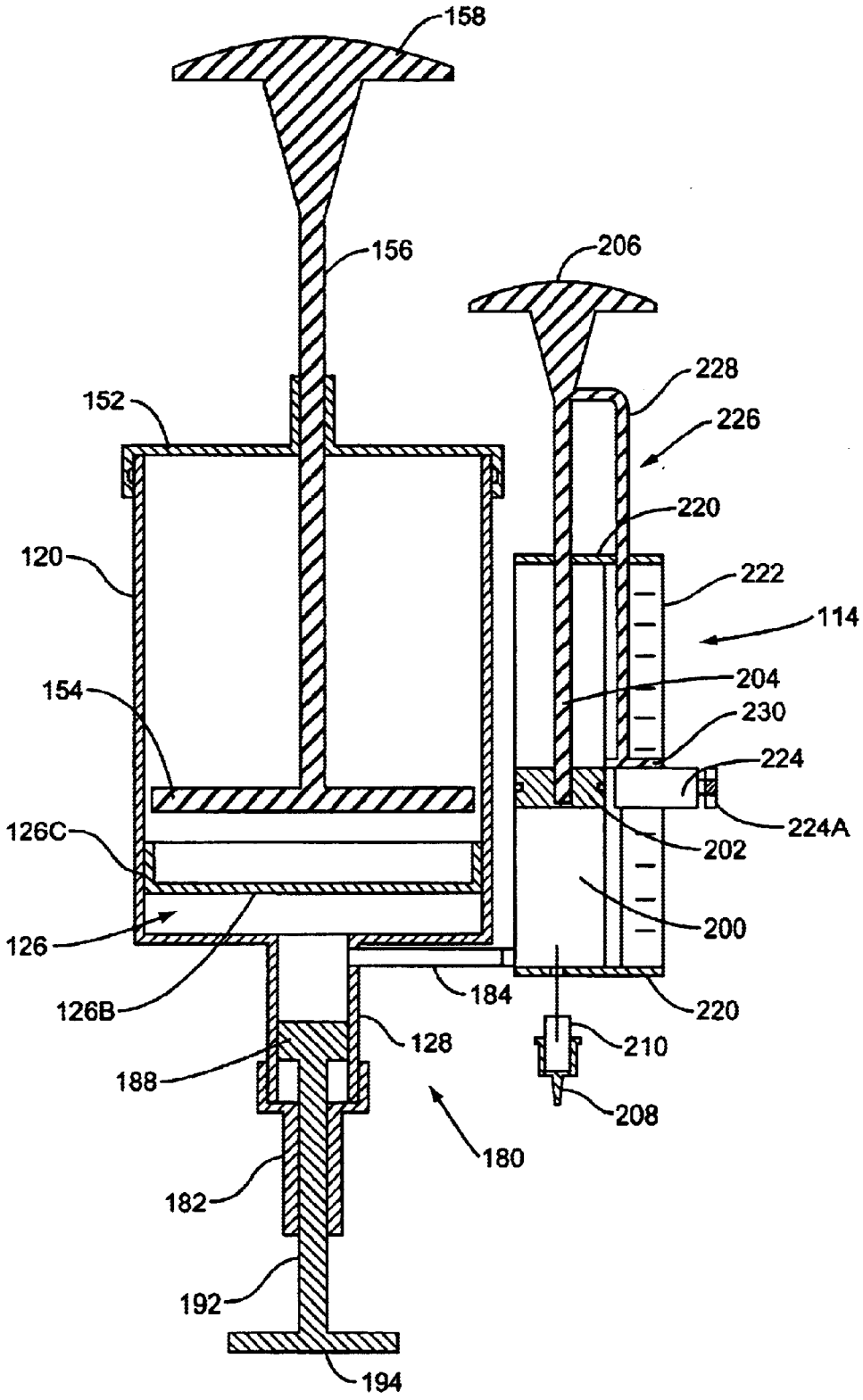
FIG. 2 is a cross-sectional view of the system for dispensing and mixing paint colorant.
Figure 3:
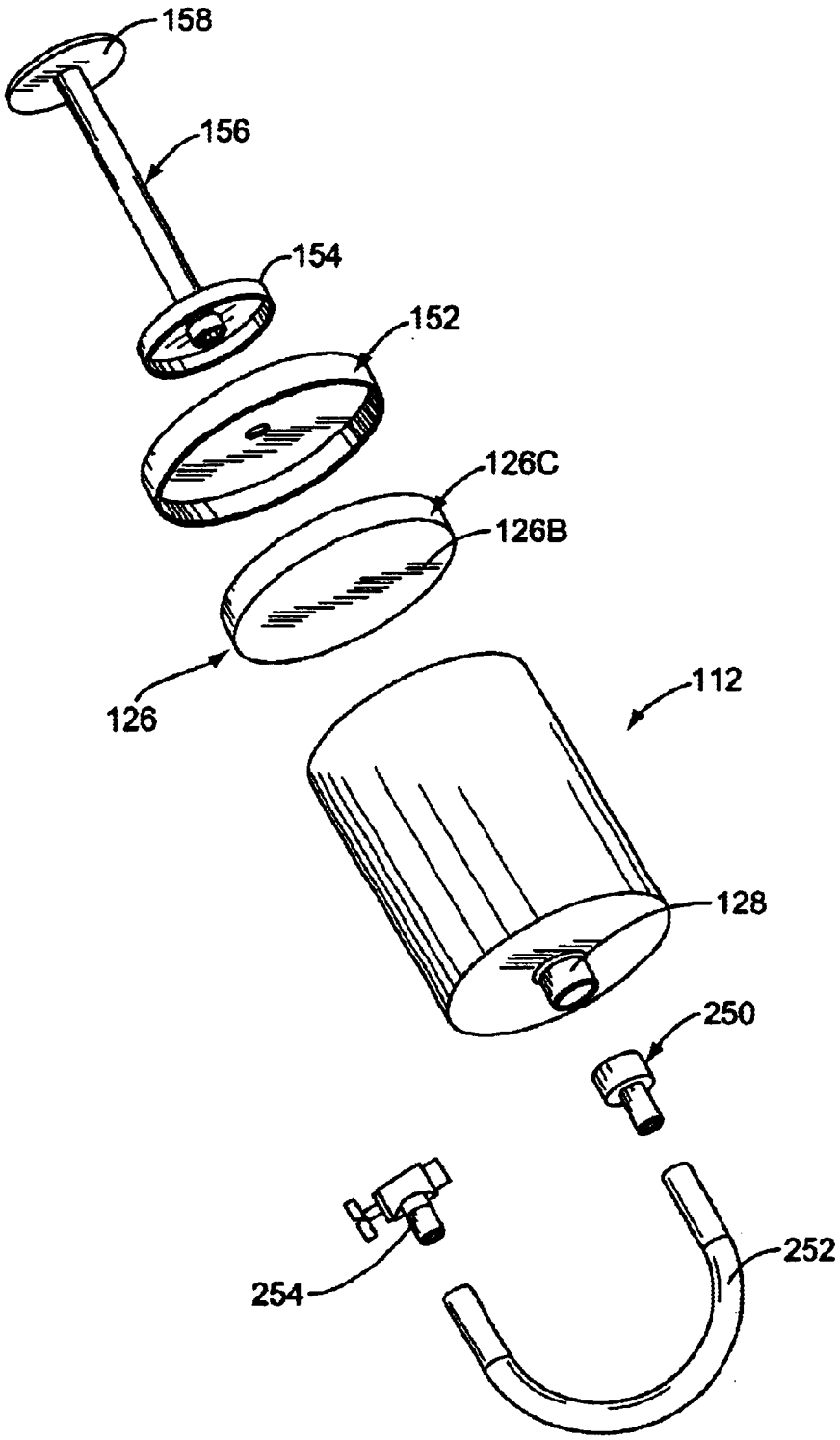
FIG. 3 is an exploded perspective view of a paint colorant container that is adapted to receive an on demand dispensing attachment that would permit paint to be dispensed from the container on an on demand basis.

With particular reference to FIGS. 1–3, the present invention also entails a paint mixing and dispensing system indicated generally by the numeral 110. Before discussing in detail the components of the mixing and dispensing system 110, it may be beneficial to view a number of the major components of the system. First the system 110 includes a container indicated generally by the numeral 112. Container 112 is designed to hold a particular paint colorant and is provided with internal means in the form of a piston for actually discharging the paint colorant from the container. As will be fully appreciated from subsequent portions of this disclosure, in one embodiment or design of the present system, it is contemplated that the container 112 will in fact form a commercial package for the paint colorant. That is, container 112 is designed to house or hold the paint colorant from the time of manufacture until it is dispensed into the paint base.

Disposed adjacent the container 112 is a dispenser indicated generally by the numeral 114. Dispenser 114 is communicatively connected to the container 112. Paint colorant is discharged from the container 112 into the dispenser 114 where the paint colorant can be selectively and precisely dispensed therefrom in small volumes.

Associated with the dispenser is an adjustable volume control mechanism indicated generally by the numeral 116. The adjustable volume control mechanism enables the dispenser to precisely dispense relatively small volumes of paint colorant. As will be appreciated from further discussions, this volume control mechanism works in conjunction with a piston that is internally disposed within the dispenser. The piston functions to discharge paint colorant from the dispenser. To control the volume of paint colorant dispensed at any one time, the adjustable volume control mechanism 116 works in conjunction with the piston of the dispenser so as to limit the stroke of the piston and consequently limit the volume of paint colorant dispensed therefrom.

Now turning to a more detailed discussion of the paint colorant mixing and dispensing system 110, the container 112 may be constructed of various materials. However, it is contemplated in a preferred embodiment, container 112 would be of a plastic construction and could be made through a blow molding process. Basically container 112 includes an enclosure or wall structure for housing and containerizing a particular paint colorant therein. Note in FIG. 2 where container 112 includes a surrounding side wall 120 and a bottom 122. Preferably formed about an upper edge of the surrounding side wall 120 is a roll top edge. Disposed internally within the container 112 is a piston or plunger indicated generally by the numeral 126. Piston 126 functions to move down through the container 112 for the purpose of urging or discharging paint colorant from the container. More particularly, the piston 126 includes an upper surface 126A and a lower surface 126B. In addition, piston 126 includes a surrounding side 126C. The surrounding side 126C is designed to form a generally sealed relationship with the side wall 120 of the container 112. Yet, the piston 126 is designed and sized such that it can be pressed downwardly through the container and as the piston 126 moves downwardly through the container the same remains generally horizontally disposed within the container and aligned therein while continuously forming a sealed relationship with the surrounding side wall 120. In other words, as the piston 126 moves downwardly through the container, the paint colorant contained therein is compelled to be discharged from the container without any significant leakage between the interface that exists between the piston 126 and the surrounding side wall 120.

Further the piston 126 and the container 112 are designed such that in use, the piston 126 will effectively discharge substantially all of the paint colorant contained within the container. Thus, the bottom portion of the container 112 in a preferred design would be particularly shaped to conform to the configuration or shape of the piston 126. Thus once the piston 126 has assumed the bottom or lower-most position within the container 112, it would follow that the piston 126 would have displaced substantially all of the paint colorant held within the container. By cleanly and efficiently discharging substantially all of the paint colorant from the container 112, enables the container 112 to be conveniently discarded or even recycled. This is to be contrasted with the conventional means of disposing of paint cans, which because of governmental regulations require such paint cans to be disposed of according to strict EPA regulations.

Formed in the bottom 122 of the container 112 is an outlet tube 128. Outlet tube 128 includes exterior threads and an outlet opening.

It is contemplated that the piston 126 will initially form the top of the container 112. As noted above, in one design the container 112 may serve as the package for the paint colorant. That is, after the paint colorant has been manufactured, it will be filled into a series of containers 112 and these containers will serve to house and containerize the paint colorant while the same is inventoried, shipped and housed or displayed at a paint store or other dispensing site. In any event, the piston 126 will initially be incorporated into the container 112 such that it does indeed form the top of the container 112. In this regard, piston 126 will be incorporated into the container such that the top surface 126A lies just below the rolled top edge. The presence of the roll top edge will prevent the piston 126 from moving upwardly and escaping from the container. At the same time, the piston 126 forms a sealed relationship with the surrounding side wall 120 and the presence of the paint colorant underlying the piston tends to further stabilize the same within the container.

Additionally, when the container 112 is initially filled with paint colorant, the opening associated with the outlet tube 128 would, of course, be closed and sealed. This could be achieved in any number of ways. In the way of an example, there may be provided a tear away Mylar seal formed over the opening. In addition to the tear away seal, a closure cap could be screwed onto the lower portion of the outlet tube 128.

Forming a part of the paint colorant mixing and dispensing system 110, is a piston push-pad assembly indicated generally by the numeral 150. As will be appreciated, the piston push-pad assembly 150 is adapted to be mounted to a top portion of the container 112 and to engage the piston 126 and to selectively push the same downwardly through the container 112 for the purpose of discharging paint colorant from the container. Viewing the piston push-pad assembly 150 in more detail, the same includes a cap 152, which could be manufactured of a plastic material designed to snap or screw onto the top portion of the container 112. Formed centrally in the cap 152 is an opening and extending through the opening is an elongated rod 156. Secured to a lower portion of the elongated rod 156 is a pressure pad 154. Secured to the opposed end portion of the rod 156 is a handle 158.

Once the piston push-pad assembly 150 has been secured to the top portion of the container 112, it follows that the pressure pad 154 is aligned with and disposed adjacent the piston 126 formed internally within the container 112. As the handle 158 and rod 156 are pushed downwardly, the pressure pad 154 will engage the piston 126 and cause the piston 126 to move downwardly through the container, and to discharge paint colorant in the process.

Also forming a part of the system of the present invention is a transfer and mixer assembly indicated generally by the numeral 180. This assembly includes a sleeve 182 that is adapted to be screwed onto the outlet tube 128 extending from container 112. Connected to the sleeve 182 and extending generally horizontally therefrom is a flow connector 184. As will be appreciated from subsequent portions of this disclosure, the flow connector 184 serves to connect the container 112 with the dispenser 114 and consequently paint colorant and flowing from the container 112 to the dispenser will flow through the flow connector. Formed about the lower portion of the transfer and mixer assembly 180 is a mixer housing. Disposed within the mixer housing is an agitator or mixer 188. In the design illustrated herein, the agitator or mixer 188 is in the form of a round plate having a series of openings (not shown) formed therein. Secured to the agitator or mixer 188 is an elongated rod 192 that extends downwardly through an opening within the transfer and mixer assembly 180. Formed on the lower terminal end of elongated rod 192 is a handle 194. It is appreciated that the opening through which the elongated rod 192 extends must be sealed. This can be achieved by use of one or more O-rings or a sealing sleeve interposed between the elongated rod 192 and the opening through which it extends.

It should be pointed out that the mixer portion of this assembly is considered to be optional. As will be discussed subsequently herein, the paint colorant mixing and dispensing system 110 of the present invention is designed to be a closed system. That is, the container 112, dispenser 114 and the flow connector 184 are designed so as to maintain the paint colorant contained therein substantially free of contact with air. It follows that if the paint colorant can be maintained substantially free of air, that significant mixing capability may not be required. However, it is appreciated that due to manufacturing restraints and tolerances that it may be difficult to practically and economically maintain the system complete closed and that some air may escape into the system and be exposed to the paint colorant contained therein. In those cases, one may find that it is appropriate to mix the paint colorant within the container 112. Accordingly, with the transfer and mixer assembly 180 of the present invention, the rod 192 can be extended upwardly and in the process the agitator or mixer 188 can be extended upwardly into the internal area of the container 112. By rapidly moving the agitator or mixer 188 up and down within the container 112, it follows that the paint colorant therein can be mixed.

Turning now to a discussion of the dispenser 114, it is seen that the same includes an elongated chamber 200. Note that the chamber 200 is relatively small in cross-sectional area compared to the cross-sectional area of the container 112. This, as will be explained in more detail later, enables precise volumes of paint colorant to be dispensed from the dispenser 114. Although the size of the chamber 200 may vary, it is contemplated that in one design the diameter would be in the range of 1 to 1½ inches and its capacity would be in the range of approximately 1 to 3 ounces of paint colorant.

As seen in FIG. 2, the flow connector 184 extends from the sleeve or tube 182 into the bottom of chamber 200. Thus paint colorant discharged from the container 112 enters the bottom of the chamber 200 of the dispenser and continues to flow upwardly into the dispenser during the dispenser filling process.

The dispenser also includes a piston for discharging the paint colorant therefrom. As noted in the drawings, a piston 202 is internally contained within the chamber 200. Piston 202 forms a sealed relationship with a surrounding wall structure of the chamber 200 such that as the piston moves downwardly within the chamber 200 a sealed relationship exists and the paint colorant disposed beneath the piston is constrained to be discharged from the dispenser while the sealed relationship between the piston 202 and the surrounding wall structure in the chamber 200 prevents the paint colorant from escaping through the interface between the piston 202 and the chamber 200. Secured to the piston 202 is a rod 204 that extends upwardly through a sealed opening formed at the top of the chamber 200. Secured to a top portion of the rod 204 is a handle 206.

In a preferred embodiment, it is contemplated that two valves disposed in series would be secured or disposed about the bottom of the dispenser 114. In this regard, it is contemplated that the first valve or the upper valve would assume the form of a one-way check valve that is schematically denoted in FIG. 6 by the numeral 210. The one-way check valve would allow the flow of paint colorant downwardly through the valve, but would not allow the flow of fluid or air upwardly through the one-way check valve into the chamber 200. Disposed below the one-way check valve is a duckbill valve 208. The duckbill valve 208 tends to prevent substantial quantities of air being exposed to the outlet end of the upwardly disposed one-way check valve.

Associated with the dispenser 114 is the adjustable volume control indicated generally by the numeral 116. As seen in the drawings, there is provided a pair of arms 220 that are secured to opposite end portions of the chamber 200 and which extend outwardly therefrom. A generally flat measuring scale 222 is connected between the arms 220. Measuring scale 222 includes a series of graduated indicia formed on one or both sides thereof. The graduated indicia is calibrated with respect to the chamber 200 such that the distance between consecutive graduations on the scale 222 represent a certain volume of paint colorant contained within the chamber 200.

Secured to the measuring scale 222 is a gauge 224. Gauge 224 slides up and down on the scale 222 and includes a thumb screw 124A for securing the gauge at any position along the scale 222.

A stop assembly, indicated generally by the numeral 226, is associated with the piston 202 disposed within the dispenser 114. Stop assembly 226 includes a rod 228 that is secured to the rod 204. Rod 228 extends outwardly from the rod 204 and turns downwardly and thereafter extends through a guide opening formed in a top arm 220. Secured to a lower terminal end portion of the rod 228 is a stop 230. Note that the stop 230 is aligned with at least a portion of the gauge 224. Viewing stop 230 in more detail, it is seen that the same includes an edge portion 230A that lies adjacent the measuring scale 222. This edge portion 230A is disposed adjacent the measuring scale 222 and runs upwardly and downwardly adjacent the same as the piston 202 is moved up and down within the chamber 200. In addition, the stop 230 includes an arcuate shaped edge 230B that extends around a portion of the chamber 200. The edges 230A and 132 may be designed to actually contact and slide against the adjacent surfaces of the measuring scale 222 and the chamber 200.

However, preferably, these edges 230A and 230B may simply be very closely spaced to these surfaces.

The chamber 200 is sized such that it will accurately dispense volumes of paint colorant as small as 1/96 of an ounce or smaller. That is, the graduations on the measuring scale 222 are such that an operator can accurately dispense a volume of paint colorant as small as 1/96 of an ounce.

In dispensing paint colorant, the piston 202 of the dispenser 114 is always initially positioned at the top of the chamber 200. That is, in the dispensing operation, before a certain volume of paint colorant is dispensed from the dispenser 114, the dispenser 114 is completely filled with paint colorant. More particularly, the piston push-pad assembly 150 is engaged and by pressing the pressure pad 154 against the piston 126 within the container 112, paint colorant is constrained or compelled to move from the container 112, through the flow connector 184, into the bottom of the chamber 200. As the piston 126 is moved downwardly within the container 112, it follows that the dispenser 114 will fill from the bottom up. Once the dispenser 114 is completely filled, it follows that the dispenser piston 202 will be disposed at the zero or top position. Thereafter, the operator determines, based on a paint formula, how much paint colorant is to be dispensed for a certain shade or tone of paint. Once that is determined, the gauge 224 is moved to a position on the measuring scale 222 that represents the correct volume of paint colorant. Assume for example, that the paint formula calls for ¼ of an ounce of a particular paint colorant. Gauge 224 is moved downwardly or upwardly as the case may be to a particular graduation that represents ¼ of an ounce. Essentially, this means that the paint colorant disposed within the chamber 200 above the line of the gauge 224 constitutes ¼ of an ounce. In any event, once the gauge 224 has been set on the measuring scale 222, then the handle 206 is pushed downwardly causing the piston to move through the chamber 200 and resulting in paint colorant being dispensed through the one-way check valve and the duckbill valve 208 disposed at the bottom of the dispenser 114. As the piston 202 moves down, it is appreciated that the stop 230 also moves downwardly with the piston. Since the stop 230 is aligned with the gauge 224 it is appreciated that the stop 230 will engage the gauge 224 and effectively stop and limit the downward movement of the piston 202. When the stop 230 engages the gauge 224, this means, of course, that the appropriate volume of paint colorant has been dispensed.

Before the next dispensing action, the dispenser 114 and particularly the chamber 200 is refilled according to the same process. That is, before each dispensing action, paint colorant from the container 112 is discharged into the dispenser 114 so as to fill the same and position the piston 202 at the top or zero position therein.

It is appreciated that the paint colorant mixing and dispensing system of the present invention would include a series of individual containers and dispensers discussed above. This is because there are an array of paint colorants typically used to form paints of different colors and tones. For example, some paint manufacturers, employ or use as many as 18 different paint colorants. These paint colorants are selectively dispensed and mixed to form a wide range of paint colors and tones. Typically, to arrive at a paint color or tone, a number of paint colorants are added to a base paint to form the desired color or tone. Therefore, in accordance with the present invention, there would be provided a container 112 and an associated dispenser 114 for each paint colorant offered for a particular manufacturer or other paint mixing system. Therefore, in accordance with the present invention, the individual containers and associated dispensers would be preferably mounted on a support structure of any type including, for example, a rotating carousel. Because the individual containers and dispensers of the present invention are designed to be closed, that is to prevent substantial quantities of air from coming into contact with the paint colorant while contained within either the container or the dispenser, little or no mixing is required. What mixing may be required, can be performed by hand by reciprocating the agitator or mixer 188 upwardly and downwardly through the container 112. This, of course, means that the paint colorant mixing and dispensing system 110 of the present invention is completely portable or mobile. Instead of being confined within a paint store or building supply house, the entire system can be transported to job sites where paint can be mixed and dispensed at the job site.

Another advantage of the present invention, is that the container 112 that forms a part of the mixing and dispensing system of the present invention can be the actual container that the paint colorant is packaged in from the outset. Thus this reduces the overall cost of the system of the present invention since a major component of the system is provided by the original package for the product. However, it should be appreciated, that the container 112 used in the present system may be a stand alone component and not form the original package for the paint colorant.

The container 112 just described can be used on an on-going basis for storing and dispensing paint on a demand basis. The system for accomplishing this is shown in the form of an alternative embodiment in FIG. 3. There it is seen that the container 112 is adapted to receive a flex connector 250. The flex connector 250 is adapted to screw onto or frictionally fit to the outlet tube 128 that depends from the bottom of the container 112. Secured to the flex connector 250 is a flexible tube 252. The flexible tube includes a remote terminal end portion that is connected to a conventional valve 254. The valve 254, of course, can be actuated back and forth between an open and closed position.

In use, the system illustrated in FIG. 3 can be used to hold and store a particular paint color. Thus a homeowner may have a number of containers 112 stored in a utility closet at his or her home. From time to time, when it comes to touching up walls, ceilings etc., the homeowner can simply go to the utility closet and dispense a selected volume of a certain paint for use. Since the system is designed to be substantially air tight, little or no mixing will be required.

Figure 4:
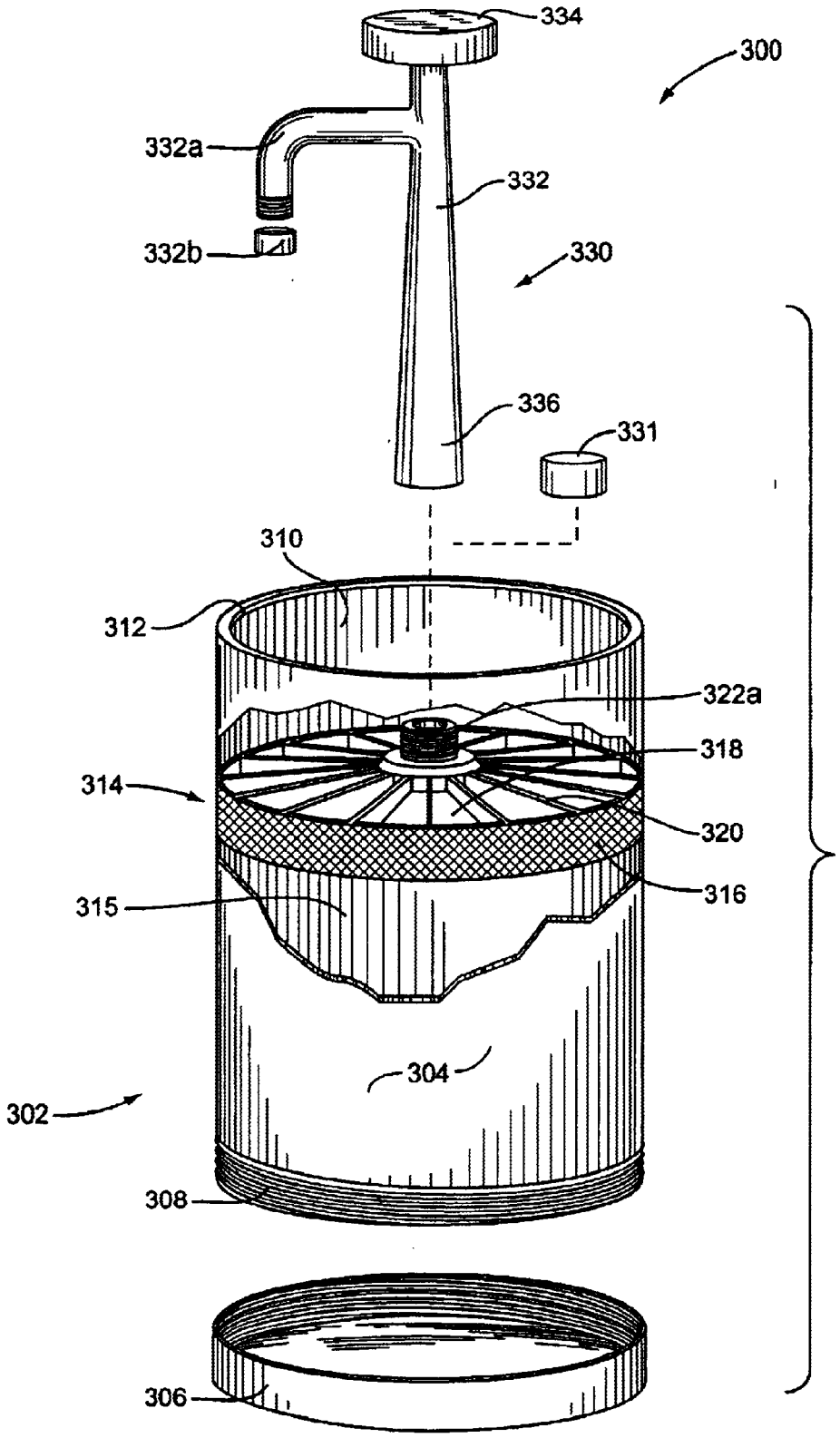
FIG. 4 is an exploded view of an alternate design for a paint dispenser.
Figure 4A:
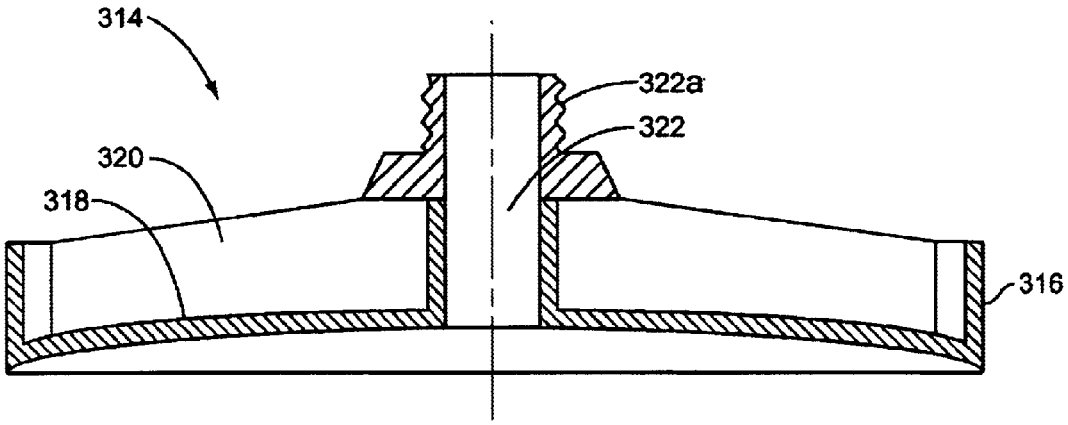
FIG. 4A is a cross sectional view of the piston of the paint dispenser of FIG. 4.

With reference to FIG. 4, an alternate embodiment for a paint dispenser is shown therein. In this alternate embodiment, the paint dispenser is indicated generally by the numeral 300. Viewing the paint dispenser 300 in more detail, it is seen that the same comprises a container, indicated generally by the numeral 302, for holding and containing paint. Container 302 may be constructed of various materials such as metal or plastic or other suitable materials. Viewing the container 302 in more detail, it is seen that the same includes a cylindrical surrounding side wall structure 304. A bottom 306 is provided. Bottom 306 is adapted to be secured to the container 302 through exterior threads 308 formed on the lower outer portion of the surrounding side wall structure 304.

Opposite bottom 306 there is provided an open top 310. Disposed adjacent to or in the vicinity of the open top 310 is a retainer 312. Retainer 312 in the embodiment illustrated in FIG. 4 is in the form of a ridge bead. As will be appreciated from subsequent portions of this disclosure, the retainer 312 is positioned about the open top 310 in order to confine or prevent a piston form being inadvertently removed from the interior of the container 302.

As noted above, there is a piston confined within the container 302. The piston is referred to generally by the numeral 314 and, like the container, the piston may be made of any suitable material such as metal or plastic. Viewing the piston 314 in more detail the piston includes a surrounding edge 316. Edge 316 is designed and adapted to form a generally liquid-tight seal with the surrounding sidewall structure 304. More particularly, the piston is specifically configured and sized to fit within the container 302 such that the piston lies in a plane generally perpendicular to the axis of the container 302. That is, the piston 314 is designed to move from the open top 310 of the container 302 towards the bottom 306. As the piston moves, it is designed and seated within the container 302 such that the piston 314 remains in a plane generally perpendicular to the axis of the container 302. At the same time, the edge 316 is constructed and configured to provide the generally liquid-tight seal with the surrounding side wall structure. It is contemplated that the liquid-tight seal can be formed by the actual edge 316 of the piston in cooperation with the interior surface of the surrounding side wall 304. Alternatively, O-rings or rubber gaskets can be provided to form the liquid-tight seal.

Further, the piston 314 includes a pair of opposed sides 318. Disposed on at least one side 318 is a series of reinforcing ribs 320. The reinforcing ribs 320 impart rigidity to the piston 314 and give the piston a quality that tends to prevent the piston from twisting or warping as the piston is pushed through the container 302. In the embodiment illustrated, the piston 314 assumes a generally dome shape. That is, the bottom of the piston 314, as viewed in FIG. 4, is configured such that it takes on a dome shape.

Further, piston 314 includes a central opening 322. Central opening 322 extends through the piston 314. Formed on the top surface of the piston 314 and aligned with the opening 322 is a flange 322*a* that includes exterior threads. In order that the piston 314 be capable of dispensing substantially all of the paint within the container 302, the upper surface of the bottom 306 would also preferably be made to form to a dome shape such that when the piston 314 is pushed into engagement with the bottom 306, the lower surface of the piston would conform to the upper surface of the bottom 306.

Consequently, the piston 314 defines a paint containing area 315 within the confines of the container 302. As viewed in FIG. 4, the paint containing area 314 lies between the lower side or portion of the piston 314 and the bottom 306.

Turning now to a discussion of the dispenser, the dispenser is shown in the drawings and indicated generally by the numeral 330. Again, the dispenser may be formed of various materials such as metal or plastic or any other suitable material. In the case of the embodiment illustrated in FIG. 4, the dispenser assumes a generally L or J-shape. More particularly, the dispenser includes a conduit 332. Secured to the upper end of the conduit, as viewed in FIG. 4, is a palm pad or handle 334. Palm pad or handle 334 is adapted or designed to be engaged by a person's hand. Further, dispenser 330 is provided about its lower end with a connector portion 336. The connector portion 336 includes internal threads that are adapted to screw onto the exterior threaded flange 332*a* that is formed about the central top area of the piston 314.

The lower portion of the conduit 332 forms an intake section. That is, when the dispenser 330 is secured to the piston 314, and the piston 314 is pressed downwardly through the container, the paint within the paint containing area 315 is forced to move through the opening 322 in the piston and into the intake section of the conduit 332. The conduit 332 includes an outlet section 332*a*. A terminal end portion of the outlet section 332*a* is threaded to receive a cap 332*b*. Thus, it is appreciated that by engaging the palm pad or handle 334 of the dispenser 330, that the piston 314 can be pushed downwardly through the container 302. Because of the liquid-tight seal that is formed between the edge 316 of the piston 314 and the surrounding wall structure 304 of the container, the force of the piston moving downwardly results in the underlying paint being urged upwardly through the piston and more particularly upwardly through the opening 322 formed in the piston. This, of course, means that the paint is urged up through the dispenser 330 and out the outlet section 332*b*.

The container 302 can in fact be a commercial package for paint. That is, the container of 302 including the piston 314 would simply constitute a manner of containerizing and packaging paint. The dispenser 330 can be marketed or sold with the container 302 or can be marketed and sold separately. In any event, once the paint has been purchased, the dispenser 330 can simply be secured to the piston by screwing the threaded connector 336 onto the threaded flange 322*a* of the piston. In such a case, it is contemplated that the piston 314 would be provided with a closure cap 331 that would be screwed into the threaded flange 322*a*. Thus, when it was desired to dispense paint from the container 302, the closure cap 331 could be removed from the piston 314 and the dispenser 330 secured to the piston 314 for dispensing.

In an alternate embodiment, the paint dispenser 300 can simply be utilized to dispense paint. That is, the container 302 can simply be periodically filled by removing the bottom 306 and refilling the container 302.

To dispense paint from the dispenser 300, a person will engage the palm pad or handle 334 with his or her hand and push downwardly towards the bottom 306 of the container 302. As the dispenser is pushed downwardly, since the dispenser is secured to the piston 314, it follows that the piston 314 will also be pushed downwardly against the paint within the paint containing area 315. This pressure or force will cause paint within the paint containing area 314 to be forced into the intake section 332*a* of the dispenser. Once the paint is forced into the intake section 332*a*, the paint will rise or move through the conduit 332. In the process, the paint will actually be transferred through the opening within the piston 314 and out the outlet section or outlet end 332*b* of the conduit 332. It follows that the quantity of paint dispensed and the volumetric rate of dispensing will depend upon the force applied to the dispenser 330 and the piston 314.

The paint dispenser design shown in FIG. 4 has numerous advantages. One advantage is that the container and its component parts including the dispenser are very easy to clean. This is particularly pertinent in the case of paints since paints can, in some circumstances, be hazardous or toxic.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. A closed system for dispensing paint colorant, comprising:

a. a container for holding a paint colorant;

b. a paint colorant dispenser disposed adjacent the container for receiving paint colorant from the container and dispensing the paint colorant therefrom;

c. a flow connector interconnecting the container and dispenser for permitting paint colorant to flow from the container to the dispenser;

d. wherein the container, dispenser and flow connector form a closed system for maintaining the paint colorant substantially free of contact with air while the paint colorant is contained within the container, dispenser and flow connector;

e. a piston disposed within the dispenser and operative to discharge paint colorant therefrom;

f. an adjustable volume control mechanism for controlling the stroke of the piston and accordingly controlling the volume of paint colorant dispersed from the dispenser; and g. wherein the container includes a piston disposed therein for discharging paint colorant from the container; and wherein there is provided a piston push assembly that is adapted to be secured to the container and wherein the piston push assembly includes a mechanism for engaging the piston within the container and urging the piston through the container so as to discharge paint colorant therefrom.

2. The closed system for dispensing paint colorant of claim 1 including means for forcing the paint colorant from the container into the dispenser.

3. The closed system for dispensing paint colorant of claim 2 including means for forcing the paint colorant from the dispenser.

4. The closed system for dispensing paint colorant of claim 1 wherein the adjustable volume control mechanism comprises a volume scale, an adjustable gauge movable relative to the volume scale; and a stop operatively associated with the piston for engaging the gauge and limiting the stroke of the piston.

5. The closed system for dispensing paint colorant of claim 4 wherein the dispenser includes an elongated chamber for holding the paint colorant, the cross-sectional area of the chamber being substantially less than the cross-sectional area of the container; and wherein the volume scale includes a series of graduations that represent volume measurements, and wherein the gauge is mounted on the volume scale and is slideable up and down thereon.

6. The closed system for dispensing paint colorant of claim 1 wherein the piston push assembly includes a cap that is adapted to be placed on a top portion of the container, a rod extending through the cap, and a push pad secured to one end portion of the rod for engaging the piston.

7. The closed system for dispensing paint colorant of claim 1 including a mixer assembly adapted to be mounted to the container, the mixer assembly including an agitator that is extendable into the container for mixing paint colorant therein.

* * * * *